US008353298B2

(12) United States Patent
Braunshteyn et al.

(10) Patent No.: US 8,353,298 B2
(45) Date of Patent: Jan. 15, 2013

(54) SMOKING ARTICLE WITH IMPACTION FILTER SEGMENT

(75) Inventors: Michael Braunshteyn, Richmond, VA (US); Rowland W. Dwyer, Richmond, VA (US); San Li, Midlothian, VA (US); Raquel Olegario, Richmond, VA (US); Gail Yoss, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 676 days.

(21) Appl. No.: 11/826,016

(22) Filed: Jul. 11, 2007

(65) Prior Publication Data

US 2008/0017204 A1 Jan. 24, 2008

Related U.S. Application Data

(60) Provisional application No. 60/830,093, filed on Jul. 12, 2006.

(51) Int. Cl.
*A24D 1/04* (2006.01)
*A24D 3/04* (2006.01)

(52) U.S. Cl. ..... 131/202; 131/336

(58) Field of Classification Search ..... 131/341, 131/202

See application file for complete search history.

(56) References Cited

U.S. PATENT DOCUMENTS 2,511,898 A 6/1950 Brothers
2,547,119 A 4/1951 Henderson
2,592,554 A 4/1952 Frankenburg
2,598,680 A 6/1952 Frankenburg
2,764,513 A 9/1956 Brothers
2,769,734 A 11/1956 Bandel
2,954,772 A 10/1960 Lebert
2,954,778 A 10/1960 Lebert
2,954,783 A 10/1960 Lebert
2,954,786 A 10/1960 Lebert
2,592,553 A 4/1962 Frankenburg et al.
3,098,492 A 7/1963 Wurzburg et al.
3,234,949 A 2/1966 White et al.
3,236,244 A 2/1966 Irby, Jr. et al.
3,255,760 A 6/1966 Selke
3,283,762 A 11/1966 Kissel (Continued)

FOREIGN PATENT DOCUMENTS

BE 679657 A 10/1966

(Continued)

OTHER PUBLICATIONS

International Preliminary Report on Patentability issued Jan. 13, 2009 for PCT/IB2007/002910.

(Continued)

*Primary Examiner* — Philip Tucker
*Assistant Examiner* — Vicki Wu
(74) *Attorney, Agent, or Firm* — Buchanan Ingersoll & Rooney PC

(57) ABSTRACT

A smoking article having a cylinder of smoking material and a filter system attached to the cylinder of smoking material. The filter system includes an upstream plug of filtering material, a downstream plug of filtering material, and a cavity between the upstream plug of filtering material and the downstream plug of filtering material. A flow restrictor is positioned within the cavity and has at least one orifice and a series of perforations provide ventilation to the smoking article.

16 Claims, 2 Drawing Sheets

U.S. PATENT DOCUMENTS 3,292,635 A 12/1966 Kolodny
3,318,312 A * 5/1967 Curtis, Jr. ..... 131/339
3,323,525 A 6/1967 Miller
3,356,094 A 12/1967 Ellis et al.
3,389,705 A 6/1968 Levavi
3,395,713 A 8/1968 Ent-Keller
3,441,028 A 4/1969 Wall
3,457,927 A 7/1969 Siragusa
3,496,945 A 2/1970 Tomkin
3,504,677 A 4/1970 Doppelt
3,581,748 A 6/1971 Cameron
3,599,646 A 8/1971 Berger et al.
3,630,210 A 12/1971 Haslam
3,637,447 A 1/1972 Berger et al.
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Jan Van Tilburg
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A * 9/1984 Browne et al. ..... 131/338
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,585,015 A 4/1986 Silberstein
4,617,946 A 10/1986 Keith
4,620,553 A 11/1986 Bale et al.
4,622,982 A 11/1986 Gaisch et al.
4,637,409 A 1/1987 Berger
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A 12/1988 Kupper et al.
4,793,365 A 12/1988 Sensabaugh et al.
4,867,182 A 9/1989 Roberts et al.
4,896,682 A 1/1990 Liew
4,924,886 A 5/1990 Litzinger
4,942,887 A 7/1990 Abdelgawad et al.
4,949,736 A 8/1990 Roberts et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A * 10/1991 Henning et al. ..... 131/336
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,817,159 A * 10/1998 Cahill et al. ..... 55/528
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,345,625 B1 2/2002 Chew
6,502,580 B1 1/2003 Luparini
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 8/2004 Dante
2004/0261807 A1 12/2004 Dube et al.
2005/0066981 A1 3/2005 Crooks et al.
2006/0201524 A1 9/2006 Zhang et al.
2007/0169785 A1 7/2007 Gedevanishvili et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0035162 A1 2/2008 Braunshteyn et al.
2008/0047571 A1 2/2008 Braunshteyn et al.
2008/0163877 A1 7/2008 Zhuang et al.
2008/0216848 A1 9/2008 Li et al.
2008/0216850 A1 9/2008 Li et al.
2008/0216851 A1 9/2008 Olegario et al.
2008/0216853 A1 9/2008 Li et al.
2010/0288293 A1 11/2010 Slasli et al.

FOREIGN PATENT DOCUMENTS

BE 1000454 A4 12/1988
DE 3439861 A1 5/1985
EP 0 054 705 A1 6/1982

| | | | | |
|---|---|---|---|---|
| EP | 0077123 | A2 | | 4/1983 |
| EP | 0101840 | A | | 3/1984 |
| EP | 0212879 | A1 | | 3/1987 |
| EP | 0 327 655 | A1 | | 8/1989 |
| EP | 0364256 | A1 | | 4/1990 |
| EP | 471581 | A1 | | 2/1992 |
| EP | 0482872 | A | | 4/1992 |
| EP | 0568107 | A | | 11/1993 |
| EP | 0481596 | B1 | | 1/1994 |
| FR | 2481581 | | | 11/1981 |
| FR | 2873899 | A | | 2/2006 |
| GB | 1058342 | A | | 2/1967 |
| GB | 1228747 | | | 4/1971 |
| GB | 1236344 | A | | 6/1971 |
| GB | 1245518 | A | | 9/1971 |
| GB | 1256154 | | * | 12/1971 |
| GB | 1256154 | A | | 12/1971 |
| GB | 1428018 | | | 3/1976 |
| GB | 2100573 | A | | 1/1983 |
| GB | 2149287 | A | | 6/1985 |
| GB | 2177890 | A | | 2/1987 |
| NZ | 19697 | | | 11/1983 |
| NZ | 216244 | | | 9/1989 |
| WO | WO 90/09741 | A | | 9/1990 |
| WO | WO 99/26495 | A | | 6/1999 |
| WO | WO 00/00047 | | | 1/2000 |
| WO | WO 01/13745 | A1 | | 3/2001 |
| WO | WO 02/03819 | A | | 1/2002 |
| WO | WO 2006/070289 | A | | 7/2006 |
| WO | WO2006082529 | A | | 8/2006 |
| WO | WO2007/093757 | A1 | | 8/2007 |
| WO | WO2007/110650 | A1 | | 10/2007 |

OTHER PUBLICATIONS

International Search Report and Written Opinion dated Jan. 24, 2008 for PCT/IB2007/002910.
International Preliminary Report on Patentability issued Jan. 13, 2009 for PCT/IB2007/002869.
International Search Report and Written Opinion dated Jan. 25, 2008 for PCT/IB2007/002869.
International Search Report and Written Opinion mailed Jan. 27, 2009 for PCT/IB2008/001348.
International Preliminary Report on Patentability issued Sep. 15, 2009 for PCT/IB2008/001348.
New Zealand Examination Report cited in New Zealand Patent Application No. 573730, Jul. 8, 2010.
International Search Resort and Written Opinion dated Oct. 7, 2008 for PCT/1B2008/001382.
International Preliminary Report on Patentability issued Sep. 15, 2009 for PCT/IB2008/001382.
International Preliminary Report on Patentability issued Feb. 10, 2009 for PCT/IB2007/003165.
New Zealand Examination Report cited in New Zealand Patent Application No. 571453, Mar. 10, 2010.
International Search Report and Written Opinion dated Mar. 26, 2008 for PCT/IB2007/003165.
U.S. Appl. No. 12/576,922, filed Oct. 9, 2009.
U.S. Appl. No. 12/782,443, filed May 18, 2010.
International Search Report mailed Sep. 13, 2010 for International Application No. PCT/EP2010/003016.
Written Opinion dated Aug. 5, 2004 for International Application No. PCT/US04/04530.
International Search Report dated Aug. 5, 2004 for PCT/US04/04530.
International Search Report dated Oct. 19, 2007 for International Application No. PCT/IB2006/004202.
Written Opinion dated Oct. 19, 2007for International Application No. PCT/IB2006/004202.
Invitation to Pay Additional Fees and Annex to Form PCT/ISA/206 Communication Relating to the Results of the Partial International Search dated Oct. 16, 2007 for International Application No. PCT/IB2006/004209.
International Search Report and Written Opinion dated Mar. 17, 2008 for PCT/IB2006/004209.
International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Preliminary Report on Patentability mailed Jul. 9, 2009 for PCT/IB2007/004503.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 7, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.

* cited by examiner

SMOKING ARTICLE WITH IMPACTION FILTER SEGMENT

CROSS REFERENCE TO RELATED APPLICATION

This application claims priority under 35 U.S.C. §119(e) to U.S. provisional Application No. 60/830,093, filed on Jul. 12, 2006, the entire content of which is incorporated herein by reference.

BACKGROUND

Cigarettes are typically categorized according to their delivery of tar (nicotine free, dry particulate matter) under standard test procedures such as the one established in 1967 by the Federal Trade Commission (FTC). The FTC method includes machine drawn puffs at 35 $cm^3$ volume for 2-second duration each, at 60-second intervals. The International Organization for Standardization (ISO) has a similar smoking protocol.

In the 1990s, additional smoking protocols were proposed, including that of the Massachusetts Department of Public Health (MDPH), one of the so-called intense smoking regimes. The MDPH method includes machine drawn puffs at 45 $cm^3$ volume for 2-second duration each, at 30-second intervals, with 50% of the cigarette filter ventilation holes blocked.

It has been found that commercial lit-end cigarettes tend to produce higher tar than FTC deliveries when puff draw volume, frequency of draw and/or puff duration are increased and/or ventilation holes are occluded in whole or in part. This tendency is reflected, for example, in differences in measurement of tar (FTC) and tar (MDPH) (i.e., Tar $(mg/cigt)_{MDPH}$/Tar $(mg/cigt)_{FTC}$), with tar (MDPH) being representative of a more intense drawing condition over that of the former.

DETAILED DESCRIPTION

Figure 1:
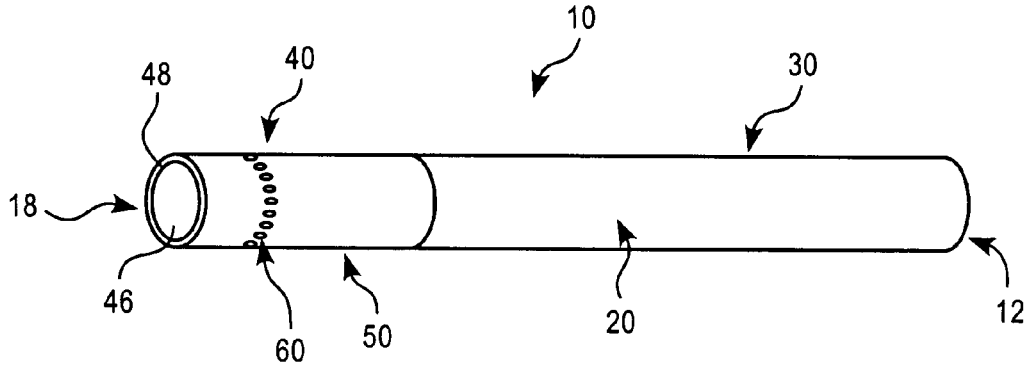
FIG. 1 is a perspective view of a smoking article in the form of a cigarette.
Figure 2:
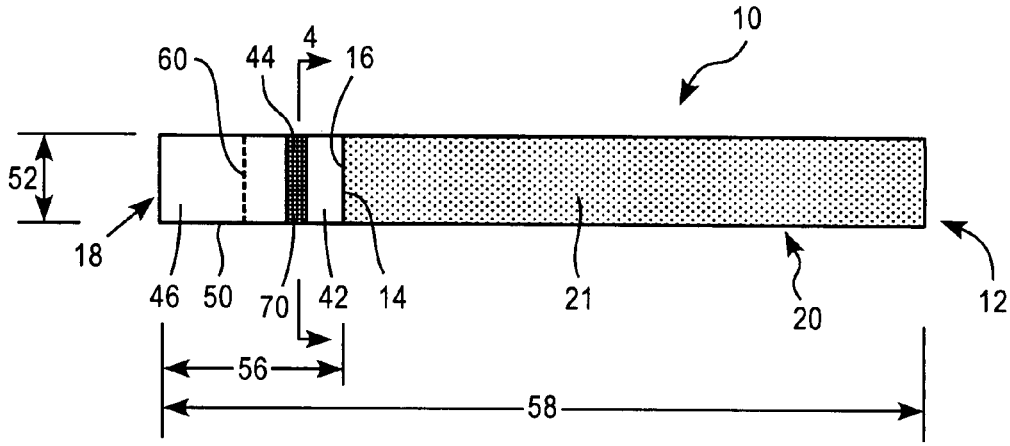
FIG. 2 is a cross sectional view of the smoking article of FIG. 1.

With reference to FIGS. 1 and 2, a smoking article 10 in the form of a cigarette typically includes a tobacco rod 20 of smoking material 21, contained in a circumscribing outer wrapper 30. The outer wrapper 30 is typically a porous wrapping material or paper wrapper. The tobacco rod 20 has a lit end 12 and a tipped end 14 (FIG. 2). The smoking material 21 is preferably a shredded tobacco or blend of tobaccos (typically called "cut filler"). However, any suitable smoking material 21 can be used.

The smoking article 10 also includes a filter system 40 adjacent to the tipped end 14 of the tobacco rod 20 such that the filter system 40 and tobacco rod 20 are axially aligned in an end-to-end relationship, preferably abutting one another. The filter system 40 has a generally cylindrical shape, and the diameter thereof is essentially equal to the diameter of the tobacco rod 20. The ends (i.e., upstream end 16 (FIG. 2) and downstream end 18) of the filter system 40 are open to permit the passage of air and smoke therethrough. The filter system 40 includes a plurality of plugs 42, 46 (FIG. 2) of filtering material and a flow constrictor 44 (FIG. 2) circumscribed by a plug wrap 48. The plug wrap 48 is typically a paper, which optionally incorporates a carbonaceous material. The plug wrap 48 circumscribes the total length of the filter system 40.

The filter system 40 attaches to the tobacco rod 20 by a tipping material 50, which circumscribes both the entire length of the filter system 40 and an adjacent region of the tobacco rod 20. The tipping material 50 is typically a paper like product; however, any suitable material can be used. The inner surface of the tipping material 50 is fixedly secured to the outer surface of the plug wrap 48 and the outer surface of the wrapping material 30 of the tobacco rod 20, using a suitable adhesive. A ventilated or air diluted smoking article 10 can be provided with an air dilution means, such as a series of ventilation holes or perforations 60, each of which extends through the tipping material 50 and (optionally) the plug wrap 48. As shown in FIG. 1, ventilation of mainstream smoke can be achieved with a circumferential row (FIG. 1) or rows of ventilation holes or perforations 60 about a location along the filter system 40. In the preferred embodiment, a ratio of total particulate matter ("TPM") and tar yield between MDPH and FTC/ISO methods is relatively constant for higher flavor delivery cigarettes, and low or ultra low flavor delivery cigarettes.

Upon lighting of the smoking article 10, the mainstream smoke is generated by and drawn from the tobacco rod 20 and through the filter system 40. Herein, the "upstream" and "downstream" relative positions between the filter system 40 and other features are described in relation to the direction of mainstream smoke as it is drawn from the tobacco rod 20 and through the filter system 40.

FIG. 2 shows a cross sectional view of FIG. 1 according to one embodiment of a smoking article 10 with the flow constrictor 44 having at least one constrictor member 70. As shown in FIG. 2, the filter system 40 is comprised of a first or upstream plug 42 of filtering material, a flow constrictor 44 and a second or downstream plug 46 of filtering material. The flow constrictor 44 comprises a constrictor member 70 having at least one orifice 72 (FIG. 4) and more preferably at least two orifices 72.

As shown in FIG. 2, the upstream plug 42 of filtering material and the downstream plug 46 of filtering material have a generally cylindrical shape, and an outer diameter 52 thereof that is essentially equal to the diameter of the tobacco rod 20. The filtering material is preferably cellulose acetate. However, it can be appreciated that the filtering material can be comprised of cellulose acetate with an activated carbon mixed throughout (often referred to as carbon-on-tow) or any other suitable filtering material and/or additives such as flavorants. The filter system 40 typically has an overall length 56 of about 15 to 40 mm for a smoking article 10 having an overall length 58 of about 80 to 160 mm. The filter system 40 also includes a plurality of ventilation holes or perforations 60 on the downstream side of the flow constrictor 44. In use, a cigarette or smoking article 10 incorporating the filter system 40 with the constrictor member 70 and the downstream ventilation holes, minimizes the ratio of total particulate matter (TPM) and tar yield by increasing the filtration efficiency with the increase of flow rate or puff volume. Specifically, the range of TPM or tar that the smoker is exposed to, by increasing puff volume, is reduced and the ratio of Tar $(mg/cigt)_{MDPH}$/Tar $(mg/cigt)_{FTC}$ is made more uniform for full flavor delivery cigarettes and low or ultra low delivery cigarettes. In addition, it has been observed generally that the first puff of a cigarette may deliver more flavor (or may be perceived to deliver more flavor) than subsequent puffs in the same cigarette.

Figure 3:
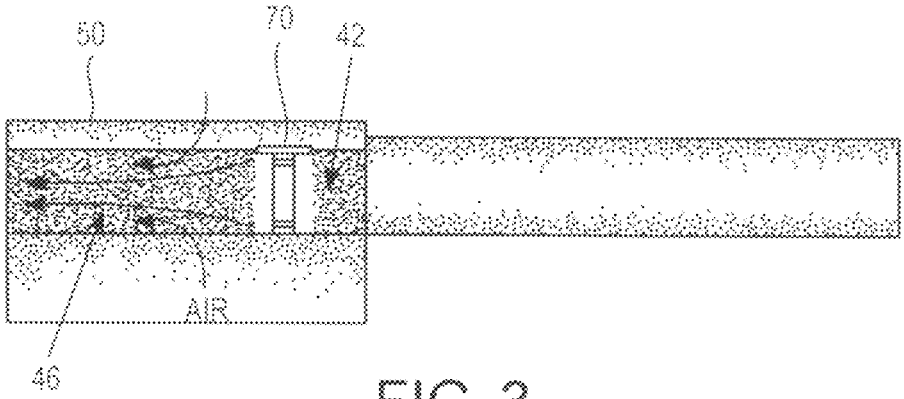
FIG. 3 is a cross sectional view of the smoking article of FIG. 1 with the tipping paper partially unwrapped.

FIG. 3 shows a cross sectional view of the smoking article 10 with the flow constrictor member 70 and the upstream plug 42. The upstream plug 42 of the filter system 40 may comprise a cellulose acetate element mixed with an activated carbon material throughout in the form of a carbon-on-tow plug of filtering material. It can also be appreciated that the plugs 42, 46 of filtering material can contain activated carbon in a cavity provided within or adjacent to the upstream and downstream plugs 42, 46 of cellulose acetate material. Alternatively, the upstream and downstream plugs 42, 46 of filtering material can contain activated carbon or other gas-vapor phase sorbents.

In FIG. 3, arrows indicate the flow of mainstream smoke from the tobacco rod which has passed through the openings in the flow constrictor member 70. Some of the particulate matter in the mainstream smoke is deposited on an end surface of the downstream plug 46 of filter material. Additional arrows indicate the flow of ventilation air into the filter through the ventilation holes. As the mainstream smoke continues through the downstream plug 46 of filter material, the ventilation air enters the downstream plug 46 and the mainstream smoke tends to move toward the center of the downstream plug 46.

Figure 4:
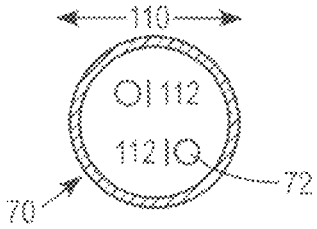
FIG. 4 is a view along the line 4-4 of FIG. 2.

FIG. 4 shows the flow constrictor member 70 of the smoking article 10 of FIGS. 2 and 3 along the line 4-4. As shown in FIG. 4, the flow constrictor member 70 has a plurality of orifices 72. The constrictor member 70 preferably has a diameter 110 of about 7.0 to 8.0 mm and more preferably about 7.4 to 7.8 mm. The constrictor member 70 preferably has at least two orifices 72 having a diameter 112 of about 0.2 to about 0.8 mm and more preferably about 0.3 to 0.6, and most preferably about 0.4 mm each. The constrictor member 70 can be made of paper, plastic, or metal, and more preferably made of a paper product or other suitable material having biodegradability properties. The constrictor member preferably is made of foamed cellulose or foamed cellulose acetate or any other type of cellulosic material or cellulose acetate that can be formed into the desired shape of the constrictor member 70. The cellulosic material may be derived from tobacco, such as a cellulosic material derived from tobacco stems.

Figure 5:
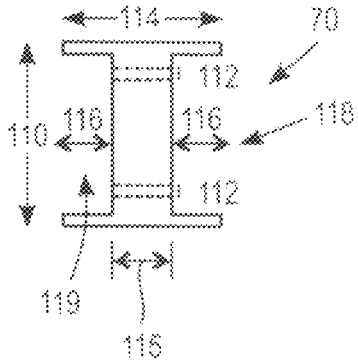
FIG. 5 is a side view of the flow constrictor of the smoking article of FIG. 4.

FIG. 5 shows a side view of the constrictor member 70 of the smoking article 10. As shown in FIG. 5, the constrictor member 70 preferably has an outer width 114 of about 2.0 to 6.0 mm and more preferably about 3.0 to 5.0 mm, and an inner width 115 of about 1.0 to 3.0 mm and more preferably about 1.5 to 2.25 mm. The spacing 116 (i.e., the difference between the outer width 114 and the inner width 115 divided by 2) is preferably about 1.5 to about 2.25 mm. The spacing 116 created by the difference in the outer width 114 and the inner width 115 forms an upstream cavity 118 and a downstream cavity 119. The upstream cavity 118 is positioned between the upstream plug 42 of filtering material and the flow constrictor 44, with the downstream cavity 119 positioned between the flow constrictor 44 and the downstream plug 46 of filtering material. The spacing especially between the flow constrictor and the downstream filter plug may be varied to vary the efficiency of the filter in removing particulate material. Similarly, the velocity of the mainstream smoke leaving the orifices and impacting the end face of the downstream filter plug affects the efficiency of the filter in removing the particulate material from the mainstream smoke. Generally, the higher the velocity, the more particulate material that is removed from the mainstream smoke at the end face of the downstream filter plug.

The annular portion of the flow constrictor is preferably spaced approximately 1-5 mm and more preferably 1-3 mm away from the end face of the downstream filter plug.

Figure 6:
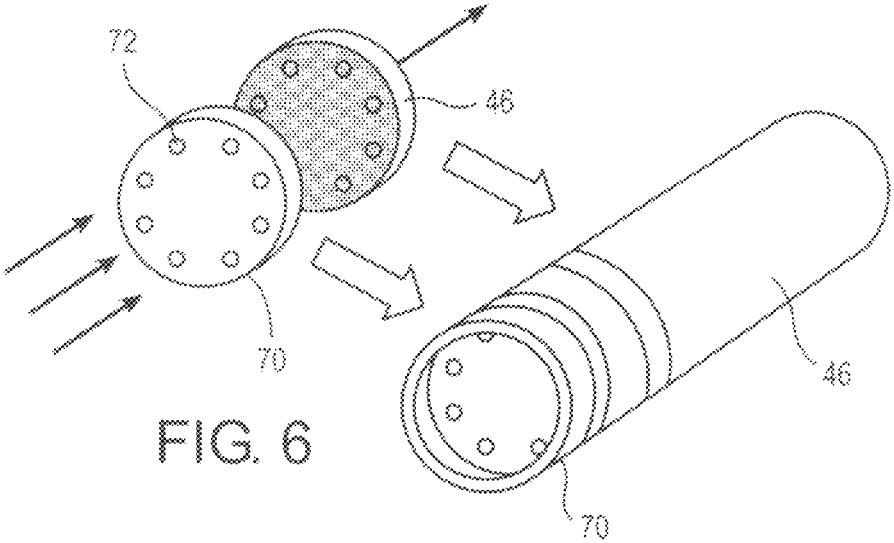
FIG. 6 is a schematic view of another flow constrictor and plug.

FIG. 6 schematically shows the flow of mainstream smoke toward the constrictor member 70 and through the orifices 72. Passage of the mainstream smoke through the orifices causes the velocity of the mainstream smoke to increase significantly as compared to the velocity of the mainstream smoke through the tobacco rod. Upon leaving the orifices 72 of the flow constrictor member 70, the larger particles of the mainstream smoke impacts an end face of the downstream plug 46 with the result that particulate matter is collected on the end face of the downstream plug 46 as indicated by the darks spots about the outer edge of the end face. These dark spots correspond directly to the location of the orifices 72 about the constrictor member 70.

The upstream plug 42 of filtering material and the downstream plug 46 of filtering material have a generally cylindrical shape, and an outer diameter that is essentially equal to the outer diameter of the tobacco rod 20. The filtering material is preferably a cellulose acetate material. However, the filtering material can be carbon-on-tow or any other suitable filtering material. The filter system 40 typically has an overall length of about 15 to 40 mm in length for a smoking article 10 having an overall length of about 80 to 160 mm. Each plug 42, 46 of filtering material can have the same length, or the upstream and downstream plugs 42, 46 can have different lengths. Also, the preferred length of the upstream and downstream plugs 42, 46 of filtering material can depend on the presence of additional materials within the filtering material such as activated carbons or other gas-vapor phase sorbent or additive materials.

As shown in FIG. 6, the flow constrictor 44 comprises the constrictor member 70 having a plurality of orifices 72 which are preferably equally spaced along the perimeter of the constrictor member. Preferably, the constrictor member is comprised of 2 orifices but may have, for example, 4 to 12 orifices 72 and, as illustrated, 8 orifices. However, it can be appreciated that any number of orifices 72 can be used. The number of orifices 72 as well as their size and position in the constrictor member depend on the desired resistance-to-draw (RTD) or pressure drop, and particulate efficiency for the filter 40. The orifices preferably have a diameter of 0.4 mm to 0.8 mm. In use, the filter of the cigarette preferably has a resistance to draw (RTD) of about 110 mm $H_2O$.

In one embodiment, the filter plugs 42, 46 are preferably low particulate efficiency filter segments constructed from cellulose acetate tow of approximately 8.0 denier per filament and approximately 35,000 total denier. In one embodiment, the flow constrictor member comprises an annular partition that defines an orifice (or flow constrictor) of reduced diameter. Preferably, the flow constrictor also includes a tubular body portion upstream and downstream of the annular partition. The tubular body portions space the annular partition a predetermined distance apart from the adjacent filter segments, preferably approximately 1 to approximately 6 millimeter (mm), and more preferably approximately 1 to 3 mm. In addition, the upstream filter segment prevents the tobacco from the tobacco rod from blocking the orifices of the annular portion of the flow constrictor.

A ventilating zone is established preferably with a row of ventilation holes through the tipping paper 16. The ventilating zone is located downstream of the flow constrictor so that air drawn through the ventilation zone may mix with the mainstream smoke before arriving at the mouthpiece.

Preferably, the ventilation zone and the hole or holes in the flow constrictor achieve a ventilation level of the smoking article of at least 25% and more preferably about 50% to 90%.

The flow constrictor preferably has end to end symmetry which facilitates high speed filter rod making in that the component works the same whether or not the rod making machine orients one end of the flow constrictor first or the reverse. Preferably the flow constrictor is sized to contribute sufficient pressure drop such that the smoking article 10 presents a resistance to draw of at least 70 mm water or greater, preferably in the range of 90-120 mm water and most preferably 110 mm water. Preferably, the flow constrictor has a diameter of approximately 7.0 to 8.0 mm and more preferably approximately 7.4 to 7.8 mm wherein the flow constrictor preferably has one or optionally, at least one orifice of a diameter of about 0.5 mm to about 0.9 mm and more preferably about 0.5 to 0.7 mm. Since the pressure drop of the flow constrictor depends on the open area, multiple orifices can also be used. For example, in one preferred embodiment there are two orifices of 0.5 mm diameter each.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a tobacco rod adapted to produce mainstream smoke;

a filter having an upstream end portion and a downstream end portion, said filter arranged to receive mainstream smoke at said upstream end portion, said filter comprising:

an upstream filter plug segment at said upstream end portion;

a downstream filter plug segment at said downstream end portion;

a flow constricting segment consisting of a tubular portion, a single transverse plate, an upstream cavity and a downstream cavity, said upstream cavity and said downstream cavity having an equal volume and defined by said tubular portion and said single transverse plate, said flow constricting segment provided at a location adjacent said downstream filter plug segment, said flow constricting segment adapted to direct mainstream smoke at a relatively high velocity, compared to the velocity of the mainstream smoke through the tobacco rod, toward an adjacent region of said downstream filter plug segment, said flow constricting segment comprising at least one opening in the single transverse plate, said at least one opening spaced away from an end face of the downstream filter plug segment by at least about 1 mm; and, tipping paper attaching said filter with said tobacco rod and including an air-admissing ventilating zone superposed with the downstream filter plug segment.

2. The smoking article of claim 1, wherein said air-admissing ventilating zone comprises a row of perforations extending through said tipping paper at said ventilating zone.

3. The smoking article of claim 1, wherein said upstream filter plug segment and said downstream filter plug segment comprise material of low particulate efficiency.

4. The smoking article of claim 2, wherein said single transverse plate comprises a plurality of openings disposed circumferentially about said single transverse plate, said single transverse plate being spaced away from the upstream filter plug segment and the downstream filter plug segment by said tubular portion, said single transverse plate being spaced away from the downstream filter plug approximately 1 to 5 mm.

5. The smoking article of claim 2, wherein said ventilation zone is positioned to promote mixing of air drawn through said ventilation zone and mainstream smoke drawn from said tobacco rod.

6. The smoking article of claim 1, wherein the flow constricting segment comprises a plurality of orifices, wherein each of the plurality of orifices has a diameter of about 0.2 mm to 0.6 mm.

7. The smoking article of claim 1, wherein a predetermined resistance-to-draw for the smoking article is at least approximately 90 millimeters water.

8. The smoking article of claim 1, wherein at least one of said upstream filter plug segment and said downstream filter plug segment comprises cellulose acetate tow of low denier.

9. A filter for a smoking article comprising a tobacco rod adapted to produce mainstream smoke, said filter comprising an upstream end portion and a downstream end portion, said filter arranged to receive mainstream smoke at said upstream end portion, said filter further comprising:

an upstream filter plug segment comprising said upstream end portion;

a downstream filter plug segment comprising said downstream end portion;

a flow constricting segment consisting of a tubular portion, a single transverse plate, an upstream cavity and a downstream cavity, said upstream cavity and said downstream cavity having an equal volume and defined by said tubular portion and said single transverse plate, said flow constricting segment provided at a location adjacent said downstream filter plug segment, said flow constricting segment adapted to direct mainstream smoke at a relatively high velocity, compared to the velocity of the mainstream smoke through the tobacco rod, toward an adjacent region of said downstream filter plug segment, said flow constricting segment comprising at least one opening in the single transverse plate, said at least one opening spaced away from an end face of the downstream filter plug segment by at least about 1 mm; and an air-admissing ventilating zone superposed with the downstream filter plug segment.

10. The filter of claim 9, wherein said upstream filter plug segment and said downstream filter plug segment comprise material of low particulate efficiency.

11. The filter of claim 10, wherein said single transverse plate comprises a plurality of openings disposed circumferentially about said single transverse plate.

12. The filter of claim 11, wherein the flow constricting segment comprises a plurality of orifices, wherein each of the plurality of orifices has a diameter of about 0.2 mm to 0.6 mm.

13. The filter of claim 12, wherein at least one of said upstream filter plug segment and said downstream filter plug segment comprises cellulose acetate tow of low denier.

14. A filter for a smoking article comprising:

an upstream filter plug segment at an upstream end portion of the filter;

a downstream filter plug segment at a downstream end portion of the filter, said upstream filter plug segment and said downstream filter plug segment comprising material of low particulate efficiency comparable to that achieved by cellulose acetate of about 8.0 denier per filament and about 35,000 total denier;

a flow constricting segment consisting of a tubular portion, a single transverse plate, an upstream cavity and a downstream cavity, said upstream cavity and said downstream cavity having an equal volume and defined by said tubular portion and said single transverse plate, said flow constricting segment provided at a location adjacent said downstream filter plug segment, said flow constricting segment comprising a plurality of openings in said single transverse plate, each of said openings having a diameter of about 0.2 mm to about 0.6 mm, said openings disposed circumferentially about said single transverse plate of said flow constricting segment, said flow constricting segment being spaced from an end face of the downstream filter plug segment by about 1 mm to about 3 mm such that said flow constricting segment operable to cause impaction of particulates during smoking on said end face; and an air-admissing ventilating zone superposed with the downstream filter plug segment.

15. The smoking article of claim 1, wherein said flow restricting segment comprises a cellulosic foam material.

16. The smoking article of claim 1, wherein the single transverse plate is planar.

* * * * *